US005641621A

United States Patent [19]

Hahm et al.

[11] Patent Number: 5,641,621

[45] Date of Patent: Jun. 24, 1997

[54] PROCESS FOR PREPARATION OF SILVER HALIDE EMULSION EMPLOYING A DOUBLE HEAT-CYCLE DURING FINISHING

[75] Inventors: Paul Timothy Hahm, Hilton; Jess Byrd Hendricks, Rochester; Heinz Ewald Stapelfeldt, Pittsford, all of N.Y.

[73] Assignee: Eastman Kodak Company, Rochester, N.Y.

[21] Appl. No.: 584,498

[22] Filed: Jan. 11, 1996

[51] Int. Cl.[6] ..... G03C 1/025; G03C 1/015; G03C 1/09; G03C 1/10

[52] U.S. Cl. ..... 430/569; 430/570; 430/603; 430/605; 430/607; 430/599

[58] Field of Search ..... 430/569, 603, 430/605, 570, 607, 599

[56] References Cited

U.S. PATENT DOCUMENTS 5,338,655 8/1994 Kubotera et al. ..... 430/569
5,439,788 8/1995 Takehara ..... 430/569

OTHER PUBLICATIONS

Research Disclosure Sep. 1994, pp. 510–514.
Article entitled Chemical Sensitization and Environmental Effects by Harbison and Spencer pp. 149–159.

*Primary Examiner*—Mark F. Huff
*Attorney, Agent, or Firm*—Paul A. Leipold

[57] ABSTRACT

The invention is directed to a process for preparation of a silver halide emulsion comprising providing an unsensitized emulsion, heating to carry out chemical sensitization of said emulsion, cooling said emulsion, heating said emulsion a second time to complete heat treatment.

14 Claims, 1 Drawing Sheet

PROCESS FOR PREPARATION OF SILVER HALIDE EMULSION EMPLOYING A DOUBLE HEAT-CYCLE DURING FINISHING

FIELD OF THE INVENTION

The invention relates to the sensitizing of silver halide emulsion grains for use in a photographic element. The invention particularly relates to a process of chemically and spectrally sensitizing silver halide emulsions, as well as treating emulsions with other photographically useful compounds in such a manner as to provide superior speed/fog performance.

BACKGROUND OF THE INVENTION

In the formation of silver halide emulsions for use in photographic materials, a desirable characteristic is to have photographic materials that are capable of being rapidly processed. It is known that silver halide emulsions having high levels of chloride content (greater than 90 mole % chloride) are especially useful in achieving rapid processability due to their higher solubility compared to emulsions having greater than some minimum levels of other halides (for example, emulsions having greater than 10 mole % bromide or more than 3–5 mole % iodide or both).

Silver halide emulsions including those high in chloride content are also known to require some form of chemical sensitization in order to increase their photographic efficiency. Chemical sensitization of an emulsion involves the addition of one or more chemical sensitizing agents where the sensitizing agent is capable of undergoing a chemical reaction on the silver halide grain surface during the application of thermal energy for some time period. The chemical sensitization involving adding chemical sensitizer to an emulsion and heating is often referred to as chemical digestion of the silver halide emulsion. Emulsions, especially high chloride content emulsions, also require spectral sensitization involving the addition of surface adsorbing sensitizing dyes to the emulsion grains which make the grains sensitive to specific wavelengths of light. In addition, silver halide emulsion grains are often treated with other photographically useful chemical compounds such as salts of other halides which can cause surface conversion of the host emulsion grains to a mixed halide composition. Other known photographically useful compounds which can be added are antifoggants, stabilizers, metal dopants, silver halide solvents, ripeners, supersensitizers, coating aids, and surfactants. These photographically useful compounds can be added prior to, during, or after the chemical sensitization or the spectral sensitization steps.

It is also known that silver halide emulsions, especially those high in chloride content, can be caused to fog or to exhibit high $D_{min}$ density as a result of the application of heat during the chemical sensitization (digestion) step. The onset of this undesirable fog or high $D_{min}$ is often the limiting factor in the performance of photographic materials composed of silver halide emulsions, and there is a continuing need to improve the speed/fog performance of these sensitized silver halide emulsions, especially emulsions containing high levels of chloride. The terms "speed" and photographic "sensitivity" are used interchangeably herein.

PROBLEM TO BE SOLVED BY THE INVENTION

There is a continuing need for means to improve the speed/fog performance of chemically and spectrally sensitized silver halide emulsions.

SUMMARY OF THE INVENTION

A primary object of this invention is to provide a means of obtaining sensitized emulsions which exhibit improved speed performance.

Another object of this invention is to provide a smaller change in emulsion speed with changing temperature of chemical sensitization (digestion) resulting in a more robust performance from emulsions containing high levels of chloride.

A further object of this invention is to provide a less heat sensitive emulsion containing high levels of chloride exhibiting a smaller change in performance with change in temperature of the coated emulsion at the time of exposure.

These and other objects of the invention are generally accomplished by providing an unsensitized emulsion, heating to carry out chemical sensitization of said emulsion, cooling said emulsion, then heating said emulsion a second time to complete heat treatment.

ADVANTAGEOUS EFFECT OF THE INVENTION

The invention provides silver halide emulsions having improved speed performance at low fog. The invention provides improved control of the finishing process and increases the effectiveness of the finishing materials used.

DETAILED DESCRIPTION OF THE INVENTION

The invention has several advantages over prior processing of silver halide emulsions. The process of the invention allows independent control of finishing and other treatments. By having separate heat cycles, it allows ideal chemical sensitization followed by more efficient addition of other materials such as antifoggants, dopants, sensitizing dyes, and material that improved the keeping of the emulsion. It is believed that the chemical sensitizing carried out in the absence of other finishing materials such as antifoggants, sensitizing dyes, and finish modifiers is often more effective, and that the finish modifiers when added after the completion of chemical sensitization also are more effective in many instances. The separation of chemical sensitization from the heat cycle for other finish materials such as antifoggants and sensitizers allows each group of materials to be added to the silver halide emulsion at the optimum temperature. These and other advantages will be apparent from the detailed description below.

Figure 1:
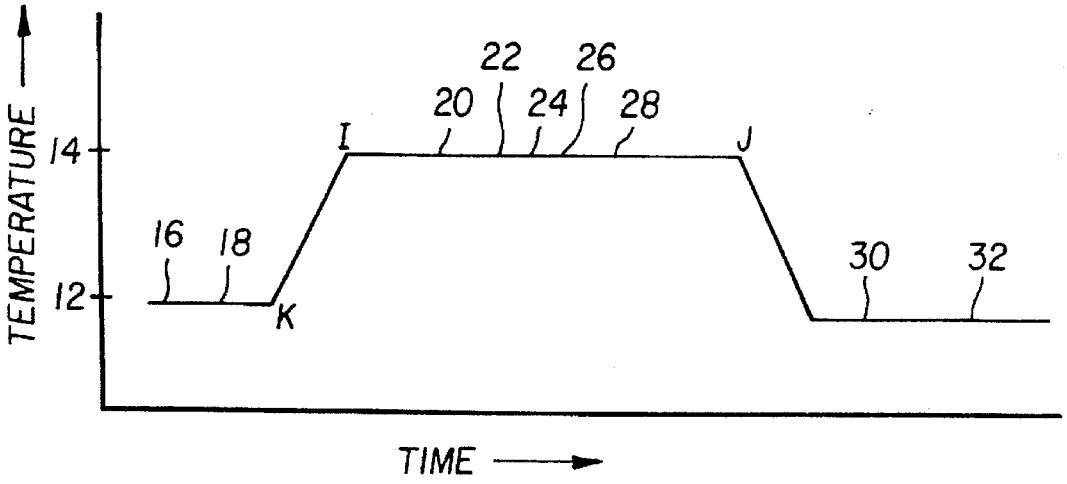
FIG. 1 is a graph representative of the time and heat cycle for conventional finishing of a silver halide emulsion.

In FIG. 1 is a time/temperature graph setting forth a conventional finishing cycle for a silver halide grain. At lower temperature 12, typically about 40° C., the sensitizing dye 16 and gold and sulfur sensitizers 18 are added. The emulsion, which is gelatin and water containing silver halide grains, then is ramped in heating from point K to point I. Point I is typically at about 55° C., and heating takes place in a typical ramp increase between about 1.5° and 2.0° C. per minute between points K and I. At point I, the temperature is maintained constant, while other additives are added to the finish. These typical additives are antifoggants 20, supersensitiziers 22, antifoggants 24, dopants 26, and finish modifiers, such as bromide, 28. The temperature is then maintained constant through J, where the temperature is ramped down generally at the same rate of change with which it was ramped up. After cooling to the base temperature of about 40° C., there further may be added pH adjusters 30 and other dyes 32 that are heat sensitive or too reactive at high temperatures.

Figure 2:
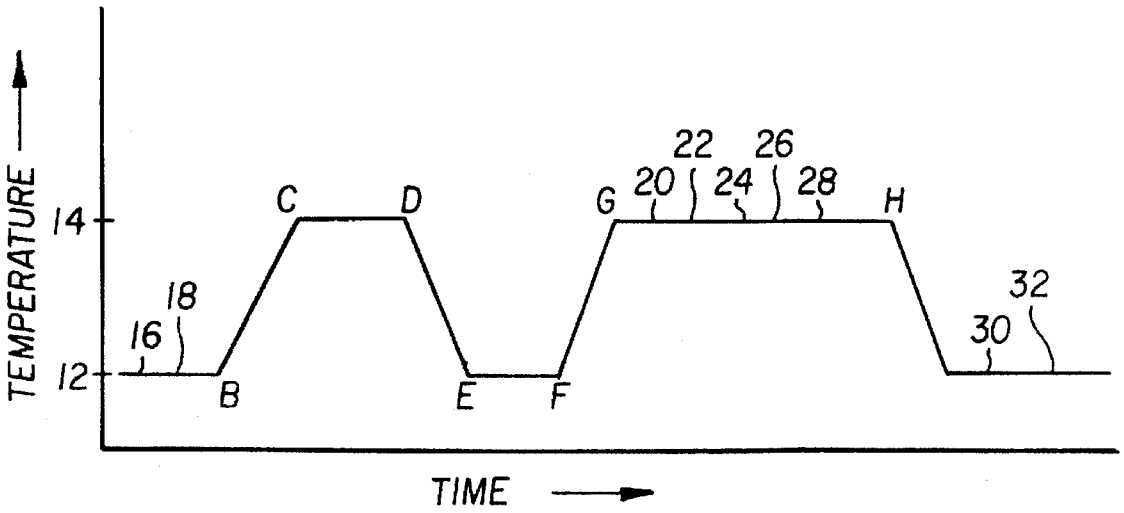
FIG. 2 is a graph of the heat finishing cycle of the invention for silver halide emulsions.

In contrast as shown in FIG. 2, there is a double heat ramp as shown in the time temperature graph there. The finish shown has the dye 16 and gold and sulfur chemical sensitizers 18 being added prior to the first heat ramp which goes from point B to point C. The higher temperature of 14 is maintained between C and D. Typically the time between C and D is between 10 and 20 minutes. Then from point D at temperature 14 the temperature is ramped down to point E and held for a suitable time such as 5 minutes, after which the heat ramp begins at F and is ramped up to point G which is shown as temperature 14 again. Then the other finishing additives 20, 22, 24, 26, and 28 are added as needed, the elevated temperature is maintained until point H after which it is ramped down again to temperature 12 where material such as pH adjuster 30 and a dye 32 may be added.

The temperatures utilized in the first and second elevated heat sections of the emulsion treatment may be any suitable temperature that results in an improved product. Typically the first heat cycle C–D is to a temperature between about 45° and 80° C. with a preferred elevated temperature of between about 55° and 65° C. It is preferred that the second temperature B–H during which the finishing material such as antifoggants and supersensitizers are added be between 50° and 60° C. It typically, however, may be between about 45° and 70° C. for suitable elements of the invention.

It is preferred that prior to the first heat rise of the invention, a gold sulfide and a sensitizing dye be added, and that during the second elevated temperature cycle, the other finishing materials be added, as it has been found that the most efficient sensitization takes place if the sensitizing dye and gold sulfide are placed through a heat cycle prior to the heating with other materials.

The time between heat cycles may be any suitable time. However, for lower cost it is considered desirable that it be kept short, such as about 5 minutes.

While it has been shown with the preferred embodiment that only chemical sensitizers and sensitizing dyes be added prior to the first heat cycle, it is also possible that in certain instances other materials, such as dopants, could be added prior to or during the first heat rise. It is preferred that during the second heat rise, antifoggants, supersensitizing dyes, dopants such as iridium, and additives such as bromide which affect the keeping properties of the emulsion be added. However, it is believed that in certain instances, other combinations of additives could be made. Further, it is believed that materials could be added prior to heating for the second heat rise rather than at the increased temperature. However, it is considered preferred to add antifoggants, dopants, and keeping additives at the increased temperature. It is noted that while the drawing of FIG. 2 illustrates the first and second heat rise being generally at the same temperature, it is within the invention and indeed preferred that the second heat rise be to a temperature about 5 degrees lower than the first for most effective finishing.

Any silver halide grain may be finished in the two-stage finishing method of the invention. Typical of such grains are bromoiodide grains, bromide grains, and bromochloroiodide of any morphology including cubic and tabular. Further, tabular silver chloride grains could be utilized. Preferred for the use of the invention are the generally cubical silver chloride grains. As shown in the examples a preferred sensitization has been achieved by the use of the two-stage heat cycle with these cubical chloride grains.

The silver halide emulsions of this invention can be precipitated by any of the methods known in the art, for example, those described in T. H. James, *The Theory of the Photographic Process* (4th Ed.), *Research Disclosure* 36544 of September 1994 in Sections I–III, or *Research Disclosure* 37038 of February 1995 in Section XV. The preferred silver halide emulsions should be high in chloride content meaning at least about 90 mole % chloride, preferably at least about 95 mole % chloride and most preferably at least 97 mole % chloride. Some bromide may incorporated during the precipitation, but the most preferred method of bromide incorporation is addition after the formation of silver chloride grains by a surface conversion process. The bulk bromide concentration should be less than 5 mole %, preferably being no more than 2.5 to 3 mole % and most preferably 0.3 to 2.0 mole %. The preferred emulsion should also contain less than 5 mole % iodide, preferably less that 2 mole % and most preferably less than 1 mole % iodide. The source of either the added bromide or iodide may be any of the commonly known salts, complexes or compounds which can suitably release the halide.

Emulsion precipitation may be conducted in the presence of any of the commonly known dispersing media including gelatin, synthetic polymers or peptizers, and conditions of precipitation may include any specific means to avoid fog such as control of pAg and pH. Furthermore, other chemical agents may also be present during the silver halide emulsion precipitation such as oxidizing agents, antifoggants, sensitizing dyes or other photographically useful compounds as described in *Research Disclosure* 37038 of February 1995 in Section XV. It is specifically contemplated to use thiosulfonate compounds alone or in combination with sulfinates or selinates during the preparation or treatment of these emulsions.

It is also contemplated to use one or more of the known useful metal dopants in preparing these high chloride content silver halides in order to modify the emulsion performance. Metal dopants include salts or coordination complexes, especially hexacoordination complexes with ligands such as halo, aquo, cyano, cyanato, thiocyanoto, nitrosyl, oxo and carbonyl ligands or combinations thereof. Preferred metal dopants are salts or coordination complexes of Group VIII metals (e.g., iron, ruthenium, rhodium, palladium, osimum, iridium, and platinum). The most preferred dopants are salts or complexes of the metals Ir, Os, Ru, and Fe. Specific examples of these dopants are described in *Research Disclosure* 37038 of February 1995 in Section XV, Part B.

The sensitization of silver halide emulsions, especially the high chloride content emulsions according to this invention, involves subjecting the silver halide grains to a double heat treatment wherein the first heat treatment is the chemical sensitization (digestion) step and the second heat treatment is a step performed in the presence of other chemical compounds known to be photographically useful. It is contemplated that the thermal history of the silver halide emulsion during the two heat treatment steps will be chosen in such a way that the treatment temperature and time will give an optimum final emulsion performance in terms of speed and fog ($D_{min}$ density). The temperature and time will depend on the choice and level of the chemical compounds that are present in the emulsion before, or during the two heat treatment steps. The temperature of the two heat treatment steps should be greater than that required to simply melt the silver halide emulsion and gelatin mixture, typically above 45° C., but usually less than about 80° C. The upper temperature of about 80° C. is determined by the rapid rate of chemical reactions at higher temperature, by thermal degradation of the gelatin or by excessive evaporation, although evaporation may be minimized by covering the reaction vessel during heating.

The chemical sensitization (digestion) can be accomplished by any of a variety of known chemical sensitizing agents such as those described in *Research Disclosure* 37038 of February 1995 in Section XV. The preferred sensitizing agents would be sulfiding agents, sources of gold, a combination of sulfur and gold or aqueous colloidal gold sulfide because of the ability these agents have to produce substantially higher emulsion speed/fog as compared to the untreated emulsion.

The invention does not rely on the utilization of any particular finishing materials to achieve the benefit of the double heat-cycle of finishing. Typical of materials suitable for use in the invention, particularly for the preferred color paper, silver chlorides are set forth in *Research Disclosure* 37038 of February 1995, particularly at pages 888–97.

The following examples illustrate the practice of the invention. They are not intended to be exhaustive of all possible variations of the invention.

EXAMPLE 1

EMULSION A: Precipitation of 10.0 mole Laboratory-scale Silver Chloride Emulsion Reactor: Demineralized water, 5.4 liters Gelatin, 38.3 grams/liter Sodium chloride salt, 2.12 grams/liter Thioether ripener (I), 0.2 grams/liter Temperature maintained at 46.0° C.

Solution 1: Silver Nitrate, 475.7 grams/liter

Solution 2: Sodium Chloride, 175.4 grams/liter

Solution 3: Dopant $K_4[Ru(CN)_6]$, 47.3 cc at 3.5 grams/liter

The precipitation is carried out by simultaneously adding solutions 1 and 2 to the well-stirred contants of the reactor. Silver nitrate is added at a rate of 0.465 moles/minute, while the sodium chloride is added in a manner to maintain the pAg relatively constant in the reactor. The dopant solution (solution 3) is added along with silver and salt from 75% to 80% of the total mass of added silver. After a total precipitation time of 21.5 minutes, the reactor temperature is reduced to 40.0° C. and the silver chloride emulsion grains are desalted by diafiltration. The final emulsion grain size was determined to be approximately 0.38 micrometers in mean cubic edge length.

Emulsion Sensitization (Chemical and Spectral) and Treatment with Other Photographically Useful Compounds Desalted emulsion A is divided into smaller samples for treatment as follows while being well stirred:

SENSITIZATION A: Single Heat Treatment (COMPARISON)

Sample A1: An emulsion sample is melted at 40.0° C., the pH is adjusted to 4.9 and the pAg is adjusted to 7.5 and then, (a) GSD-1 is added to the emulsion, 25 mg/silver mole.

(b) Colloidal gold sulfide is added to the emulsion, 46.3 mg $Au_2S$/mole.

(c) The emulsion is heated to 50.0° C. at 1.67° C./minute.

(d) After 28 minutes at 50.0° C., add AF-1 at 286 mg/mole.

(e) After 40 minutes at 50.0° C., add SS-1 at 60 mg/mole.

(f) After 47 minutes at 50.0° C., add AF-2 at 100 mg/mole.

(g) After 51 minutes at 50.0° C., add MD-1 at 0.047 mg/mole.

(h) After 55 minutes at 50.0° C., add KBr equal to 1.6 mole %.

(i) After 74 minutes at 50.0° C., the emulsion sample is cooled to 40.0° C. at 1.67° C./min.

(j) Sample pH is adjusted to 6.5, add RSD-1, 20 mg/mole.

(k) Emulsion sample is chill-set for later remelting and coating.

Sample A2: This sample is treated like Sample A1 except that the single heat treatment is at a temperature of 55.0° C.

Sample A3: This sample is treated like Sample A1 except that the single heat treatment is at a temperature of 60.0° C.

Sample A4: This sample is treated like Sample A1 except that the single heat treatment is at a temperature of 65.0° C.

Sample A5: This sample is treated like Sample A1 except that the single heat treatment is at a temperature of 70.0° C.

Sample A6: This sample is treated like Sample A1 except that the single heat treatment is at a temperature of 75.0° C.

SENSITIZATION B: Double Heat Treatment (INVENTION)

Sample B1: Emulsion sample is melted at 40.0° C., then the pH is adjusted to 4.9 and the pAg is adjusted to 7.5, then, (a) GSD-1 is added to the emulsion at 25 mg/silver mole.

(b) Colloidal gold sulfide is added to the emulsion at 46.3 mg/mole.

(c) The emulsion is subjected to a first heat treatment by heating to 50.0° C. at 1.67° C./minute.

(d) After 17 minutes at 50.0° C., the emulsion sample is cooled to 40.0° C. at 1.67° C./min. and held for 5 minutes.

(e) The emulsion is subjected to a second heat treatment by heating to 50.0° C. at 1.67° C./minute.

(f) After 1 minute at 50.0° C., add AF-1 at 286 mg/mole.

(g) After 13 minutes at 50.0° C., add SS-1 at 60 mg/mole.

(h) After 20 minutes at 50.0° C., add AF-2 at 100 mg/mole.

(i) After 24 minutes at 50.0° C., add MD-1 at 0.047 mg/mole.

(j) After 28 minutes at 50.0° C., add KBr equal to 1.6 mole %.

(k) After 47 minutes at 50.0° C., the emulsion sample is cooled to 40.0° C. at 1.67° C./minute.

(l) Sample pH is adjusted to 6.5, add RSD-1 at 20 mg/mole.

(m) Emulsion sample is chill-set for later remelting and coating.

Sample B2: This sample is treated like Sample B1 except that the second heat treatment is at a temperature of 55.0° C.

Sample B3: This sample is treated like Sample B1 except that the second heat treatment is at a temperature of 60.0° C.

Sample B4: This sample is treated like Sample B1 except that the second heat treatment is at a temperature of 65.0° C.

Sample B5: This sample is treated like Sample B1 except that the second heat treatment is at a temperature of 70.0° C.

Sample B6: This sample is treated like Sample B1 except that the second heat treatment is at a temperature of 75.0° C.

Sample C1: This sample is treated like Sample B1 except that the first heat treatment is at a temperature of 55.0° C.

Sample C2: This sample is treated like Sample C1 except that the second heat treatment is at a temperature of 55.0° C.

Sample C3: This sample is treated like Sample C1 except that the second heat treatment is at a temperature of 60.0° C.

Sample C4: This sample is treated like Sample C1 except that the second heat treatment is at a temperature of 65.0° C.

Sample C5: This sample is treated like Sample C1 except that the second heat treatment is at a temperature of 70.0° C.

Sample C6: This sample is treated like Sample B1 except that the second heat treatment is at a temperature of 75.0° C.

Sample D1: This sample is treated like Sample B1 except that the first heat treatment is at a temperature of 60.0° C.

Sample D2: This sample is treated like Sample D1 except that the second heat treatment is at a temperature of 55.0° C.

Sample D3: This sample is treated like Sample D1 except that the second heat treatment is at a temperature of 60.0° C.

Sample D4: This sample is treated like Sample D1 except that the second heat treatment is at a temperature of 65.0° C.

Sample D5: This sample is treated like Sample D1 except that the second heat treatment is at a temperature of 70.0° C.

Sample D6: This sample is treated like Sample D1 except that the second heat treatment is at a temperature of 75.0° C.

Sample E1: This sample is treated like Sample B1 except that the first heat treatment is at a temperature of 65.0° C.

Sample E2: This sample is treated like Sample E1 except that the second heat treatment is at a temperature of 55.0° C.

Sample E3: This sample is treated like Sample E1 except that the second heat treatment is at a temperature of 60.0° C.

Sample E4: This sample is treated like Sample E1 except that the second heat treatment is at a temperature of 65.0° C.

Sample E5: This sample is treated like Sample E1 except that the second heat treatment is at a temperature of 70.0° C.

Sample E6: This sample is treated like Sample E1 except that the second heat treatment is at a temperature of 75.0° C.

Sample F1: This sample is treated like Sample B1 except that the first heat treatment is at a temperature of 70.0° C.

Sample F2: This sample is treated like Sample F1 except that the second heat treatment is at a temperature of 55.0° C.

Sample F3: This sample is treated like Sample F1 except that the second heat treatment is at a temperature of 60.0° C.

Sample F4: This sample is treated like Sample F1 except that the second heat treatment is at a temperature of 65.0° C.

Sample F5: This sample is treated like Sample F1 except that the second heat treatment is at a temperature of 70.0° C.

Sample F6: This sample is treated like Sample F1 except that the second heat treatment is at a temperature of 75.0° C.

Sample G1: This sample is treated like Sample B1 except that the first heat treatment is at a temperature of 75.0° C.

Sample G2: This sample is treated like Sample G1 except that the second heat treatment is at a temperature of 55.0° C.

Sample G3: This sample is treated like Sample G1 except that the second heat treatment is at a temperature of 60.0° C.

Sample G4: This sample is treated like Sample G1 except that the second heat treatment is at a temperature of 65.0° C.

Sample G5: This sample is treated like Sample G1 except that the second heat treatment is at a temperature of 70.0° C.

Sample G6: This sample is treated like Sample G1 except that the second heat treatment is at a temperature of 75.0° C.

FORMAT FOR EMULSION PERFORMANCE EVALUATION

A multicolor, multilayer coating was prepared as a photographic recording element of this invention using the example emulsions in the red sensitive/cyan dye imaging silver halide layer in the following structure:

| | |
|---|---|
| Gel overcoat layer, Red sensitive/cyan dye imaging silver halide layer | 1.076 g gel/sq. meter |
| Gel at | 1.430 g/sq. meter |
| Silver coverage = | 0.240 g Ag/sq. meter |
| Coupler CC-1 at | 0.422 g/sq. meter |
| Interlayer | |
| Green sensitive/magenta dye imaging silver halide layer | |
| Gel at | 1.237 g/sq. meter |
| Silver coverage = | 0.122 g Ag/sq. meter |

-continued

| | |
|---|---|
| Coupler MC-1 at | 0.355 g/sq. meter |
| Interlayer | |
| Blue sensitive/yellow dye imaging silver halide layer | |
| Gel at | 1.506 g/sq. meter |
| Silver coverage = | 0.218 g Ag/sq. meter |
| Coupler YC-1 at | 1.076 g/sq. meter |
| Polyethylene Coated Reflection support | |

PHOTOGRAPHIC PERFORMANCE EVALUATION

Each of the multicolor, multilayer coatings was exposed by a 1700 Lux tungsten lamp with a 3000° K. temperature for 0.5 seconds followed by processing in KODAK EKTACOLOR RA-4 chemistry in a roller transport processor. Filtration for the red sensitive layer was a Wratten 70, for the green sensitive layer a Wratten 99+0.3 neutral density, and for the blue Wratten 48+2B+0.8 neutral density. Emulsion coating performance was judged by measuring (a) photographic sensitivity (speed) in relative Log exposure units at a density of 0.8, (b) a lower scale "toe" density at 0.2 Log E lower exposure than the speed point, or (c) measuring fog/$D_{min}$ as the lowest density in the unexposed area of the processed coating.

Table I shows the performance of (comparison) emulsions given a single heat treatment during which both chemical sensitization and treatment with other photographically useful compounds occurred.

TABLE I

Emulsion Sensitivity Performance for Single Heat Treatment

| Sample Emulsion | Temperature of Single Heat Treatment | Relative Photographic Sensitivity (Log exp.) |
|---|---|---|
| A1 (Comparison) | 50° C. | 1.52 |
| A2 (Comparison) | 55° C. | 1.63 |
| A3 (Comparison) | 60° C. | 1.67 |
| A4 (Comparision) | 65° C. | 1.67 |
| A5 (Comparision) | 70° C. | 1.50 |
| A6 (Comparision) | 75° C. | 1.24 |

Table II shows the performance of emulsions given a double heat treatment of the invention wherein during chemical sensitization and the treatment in the presence of other photographically useful compound, temperatures were varied independently.

TABLE II

| | Emulsion Sensitivity Performance for Double Heat Treatment | | | | | | | | | | | |
|---|---|---|---|---|---|---|---|---|---|---|---|---|
| | Second Heat at 50° C. | | Second Heat at 55° C. | | Second Heat at 60° C. | | Second Heat at 65° C. | | Second Heat at 70° C. | | Second Heat at 75° C. | |
| | Sample | Speed | Sample | Speed | Sample | Speed | Sample | Speed | Sample | Speed | Sample | Speed |
| First Heat at 50° C. | B1 | 1.58 | B2 | 1.60 | B3 | 1.60 | B4 | 1.56 | B5 | 1.52 | B6 | 1.26 |
| First Heat at 55° C. | C1 | 1.67 | C2 | 1.66 | C3 | 1.66 | C4 | 1.51 | C5 | 1.52 | C6 | 1.14 |
| First Heat at 60° C. | D1 | 1.75 | D2 | 1.68 | D3 | 1.68 | D4 | 1.63 | D5 | 1.55 | D6 | 1.31 |
| First Heat at 65° C. | E1 | 1.76 | E2 | 1.71 | E3 | 1.68 | E4 | 1.65 | E5 | 1.551 | E6 | 1.22 |
| First Heat at 70° C. | F1 | 1.85 | F2 | 1.72 | F3 | 1.65 | F4 | 1.65 | F5 | 1.54 | F6 | 1.25 |
| First Heat at 75° C. | G1 | 1.74 | G2 | 1.70 | G3 | 1.67 | G4 | 1.66 | G5 | 1.48 | G6 | 1.19 |

It can be seen from Table I and Table II that the invention provides superior photographic speed than the comparison, especially where the temperature of the second heating is 50°–60° C. and superior photographic speed over a wider temperature range of the first heating at a second heating temperature of 50°–55° C. At the same time, fog/Dmin was acceptable in all cases.

EXAMPLE 2

An emulsion like that described in EXAMPLE 1 (EMULSION A) is treated as follows:

Sample H1: (INVENTION) An emulsion sample is melted at 40.0° C., the pH is adjusted to 4.9 and the pAg is adjusted to 7.5 and then, (a) GSD-1 is added to the emulsion at 20 mg/silver mole.

(b) Colloidal gold sulfide is added to the emulsion at 46.3 mg/mole.

(c) The emulsion is subjected to a first heat treatment by heating to 50.0° C. at 1.67° C./minute.

(d) After 17 minutes at 65.0° C., the emulsion sample is cooled to 40.0° C. at 1.67° C./minute and held for 5 minutes.

(e) The emulsion is subjected to a second heat treatment by heating to 65.0° C. at 1.67° C./minute.

(f) After 1 minute at 65.0° C., add AF-1 at 286 mg/mole.

(g) After 13 minutes at 65.0° C., add SS-1 at 60 mg/mole.

(h) After 20 minutes at 65.0° C., no AF-2 is added.

(i) After 24 minutes at 65.0° C., add MD-1 at 0.047 mg/mole.

(j) After 28 minutes at 65.0° C., add KBr equal to 1.6 mole %.

(k) After 47 minutes at 65.0° C., the emulsion sample is cooled to 40.0° C. at 1.67° C./min.

(l) Sample pH is adjusted to 6.0, add RSD-1 at 20 mg/mole.

(m) Emulsion sample is chill-set for later remelting and coating.

Sample H2: (INVENTION) Another emulsion sample is treated as sample H1, except that the level of the photographically useful coumpound AF-2 added at 65.0° C. during the second heat treatment step is 50 mg/silver mole.

Sample H3: (INVENTION) Another emulsion sample is treated as sample H1, except that the level of the photographically useful coumpound AF-2 added at 65.0° C. during the second heat treatment step is 100 mg/silver mole.

Sample H4 and H5: (COMPARISON) Two emulsion samples are treated as sample H2 and H3 except that the photographically useful coumpound AF-2 is added at 40.0° C. after the second heat treatment (after the "doctoring" step).

Sample H6 and H7: (COMPARISON) Two emulsion samples are treated as sample H2 and H3 except that the photographically useful coumpound AF-2 is added at 40.0° C. after the second heat treatment (after the "doctoring" step).

These emulsion samples were melted and coated in the same format as described in EXAMPLE 1. Here, however, the emulsion performance evaluation involved testing their sensitivity to the temperature of the coating at the time of exposure. Coating samples were exposed at 60° F. and 100° F. to determine the effect of temperature on lower scale toe density. Table III shows these data.

TABLE III

| | Change in Lower Scale Toe Density from 60° F. to 100° F. | | | | | |
|---|---|---|---|---|---|---|
| | Compound AF-2 added in first heating (Comparison) | | Compound AF-2 added in second heating (Invention) | | Compound AF-2 added after second heating (Comparison) | |
| | Sample Number | Toe Density | Sample Number | Toe Density | Sample Number | Toe Density |
| 0.0 mg AF-2/mole | H1 | 0.08 | H1 | 0.08 | H1 | 0.08 |
| 50.0 mg AF-2/mole. | H2 | 0.05 | H4 | 0.04 | H6 | See Note |
| 100.0 mg AF-2/mole | H3 | 0.03 | H5 | 0.02 | H7 | See Note |

Note: Toe density measurements were not recorded for emulsion samples H6 and H7 because very large speed losses were observed with the addition of AF-2 after the second heating which rendered the emulsions too slow to be useful regardless of their low toe properties.

It can be seen from Table III that the invention provides lower sensitivity to coated photographic material temperature during exposure than the comparison, or retains a higher useful photographic speed where the comparison suffers a substantial speed loss.

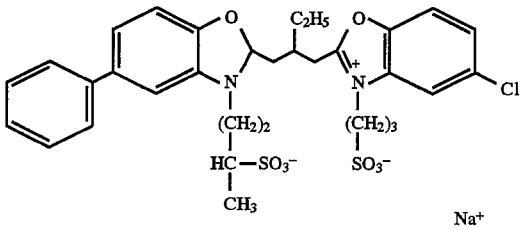
GSD-1
$Na^+$ or $1/2\ Ca^{+2}$ or $HN^+(C_2H_5)_3$
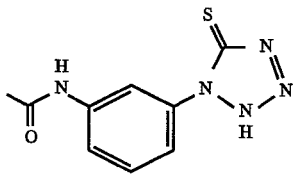
AF-1
NaH
SS-1
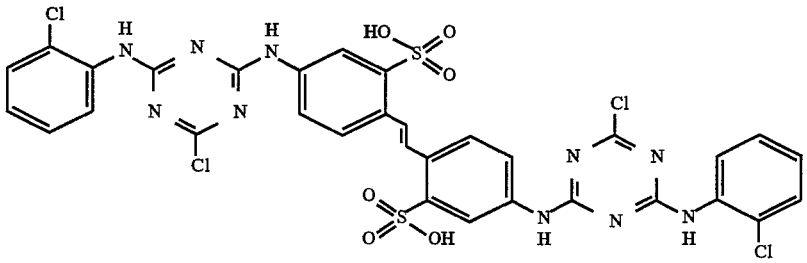
KH 10 parts AF-Z MD-1 = $K_2Ir(Cl)_6$
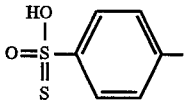
NaH 1 part
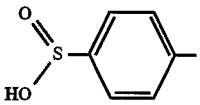
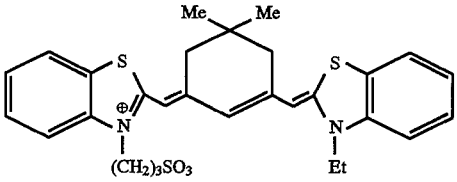
ASD-1
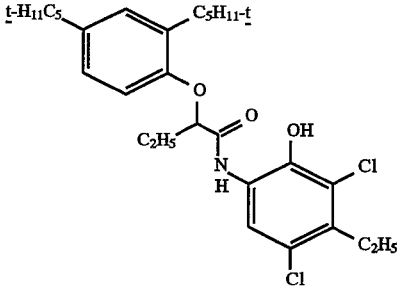
CC-1
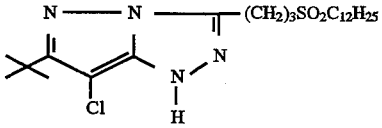
MC-1
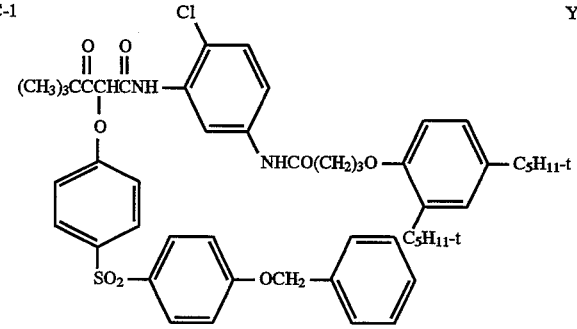
YC-1
I = 2,2'-(ethylene-dithiodiethanol)
The invention has been described in detail with particular reference to preferred embodiments thereof, but it will be understood that variations and modifications can be effected within the spirit and scope of the invention.

We claim:

1. A process for preparation of a silver halide emulsion comprising providing an unsensitized emulsion, heating to carry out chemical sensitization of said emulsion, cooling said emulsion, heating said emulsion a second time to complete heat treatment wherein said first heating is between 45° and 80° C. and said second heating is between 45° and 70° C.

2. The process of claim 1 wherein chemical sensitizers utilized during chemical sensitization comprise sulfiding agents, gold sources, combinations thereof or colloidal gold sulfide in gelatin.

3. The process of claim 1 wherein during said second heating time spectral sensitizers and antifoggants are added.

4. The process of claim 3 wherein said cooling is to about 40° C.

5. The process of claim 1 wherein during the second heating antifoggant is added.

6. The process of claim 1 wherein during the second heating at least one material selected from dopants, antifoggants, bromide salts or compounds, spectral sensitizers, supersensitizers or dye deaggregants is added.

7. The process of claim 1 wherein chemical sensitizers are added prior to heating to carry out chemical sensitization.

8. The process of claim 1 wherein after said emulsion has been heated a second time, at least one material selected from the group consisting of dopants, antifoggants, bromide salts or compounds, spectral sensitizers, supersensitizers, and dye aggregates are added.

9. The process of claim 1 wherein said unsensitized emulsion comprises an emulsion that is greater than 90% chloride.

10. The process of claim 1 wherein said unsensitized emulsion comprises a silver halide emulsion having a grain size of between about 0.15 and about 1.5 micrometers.

11. The process of claim 10 wherein said grain size is between about 0.2 and 1.0 micrometer.

12. The process of claim 1 wherein said first heating is between about 55° and about 65° C.

13. The process of claim 1 wherein said heating said emulsion a second time is to a temperature of between about 50° and about 60° C.

14. The process of claim 1 wherein said cooling is to about 40° C.

* * * * *